US005790080A

United States Patent [19]

Apostolos

[11] Patent Number: 5,790,080

[45] Date of Patent: Aug. 4, 1998

[54] MEANDER LINE LOADED ANTENNA

[75] Inventor: John T. Apostolos, Merrimack, N.H.

[73] Assignee: Lockheed Sanders, Inc., Nashua, N.H.

[21] Appl. No.: 389,866

[22] Filed: Feb. 17, 1995

[51] Int. Cl.[6] ..... H01Q 11/14

[52] U.S. Cl. ..... 343/744; 343/745

[58] Field of Search ..... 343/741, 731, 343/792.5, 710, 744, 745, 728; H01Q 11/02, 11/04, 11/14

[56] References Cited

U.S. PATENT DOCUMENTS 2,840,700 6/1958 Browder ..... 343/710

3,633,207 1/1972 Ingerson et al. ..... 343/792.5

3,696,438 10/1972 Ingerson ..... 343/792.5

*Primary Examiner*—Michael C. Wimer

*Attorney, Agent, or Firm*—David W. Gomes

[57] ABSTRACT

An antenna includes one or more conductive elements for acting as radiating antenna elements, and a slow wave meander line adapted to couple electrical signals between the conductive elements, wherein the meander line has an effective electrical length which affects the electrical length and operating characteristics of the antenna. The electrical length and operating mode of the antenna may be readily controlled.

4 Claims, 4 Drawing Sheets

$Z_0 = \sqrt{Z_1 Z_2}$

PROPAGATION CONSTANT $\beta = \beta_0/2 \sqrt{\frac{Z_1}{Z_2}}$

WHERE $\beta_0 = 2\pi/\lambda_0$

MEANDER LINE LOADED ANTENNA

RELATED APPLICATIONS

The present application is related to co-pending U.S. Pat. application Ser. No. 08/389,868 entitled SLOW WAVE MEANDER LINE, filed Feb. 17, 1995by the same inventor, the contents of which are hereby incorporated by reference herein.

BACKGROUND OF THE INVENTION

1. Field of the Invention

The present invention generally relates to meander line loaded antennas, and particularly to such antennas having a slow wave meander line.

2. Statement of the Prior Art

It is well known that there is a fundamental limitation upon the performance of antennas and radiating structures as their dimensions diminish to much less than a wavelength. that effect is expressed by the so-called Chu-Harrington relation: Efficiency=$FV_2Q$ where: Q=Quality Factor $V_2$ =Volume of the structure in cubic wavelengths F=Geometric form factor.

For a sphere or cube, F=64.

Conversely, the proliferation of wireless communication devices drives a constant physical need for smaller, less obtrusive and more efficient antennas.

It is also known that anenna performance is dependent upon the relationship between antenna length and the wavelength of the desired frequency of operation. This relationship determines the operating mode of the antenna, which modes are labeled as fractional parts of the wavelength. It is further known that the electrical length of an antenna may be considerably changed by the series connection of a coil therewith.

SUMMARY OF THE INVENTION

Accordingly, it is an object of the present invention to provide an antenna design with improved efficiency in terms of size or form factor versus electrical performance.

The present invention provides an antenna, comprising: one or more conductive elements for acting as radiating antenna elements; and a slow wave meander line means adapted to couple electrical signals between the conductive elements, wherein the meander line means has an effective electrical length which affects the electrical length and operating characteristics of the antenna.

BRIEF DESCRIPTION OF THE DRAWINGS

The present invention is illustratively described in reference to the appended drawings in which.

DETAILED DESCRIPTION OF THE DRAWINGS

Figure 1:
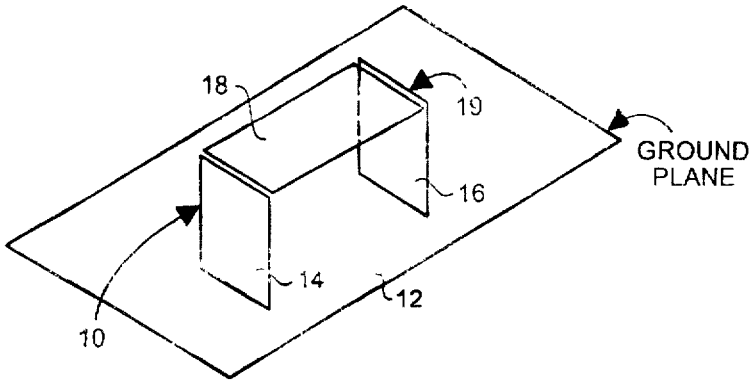
FIG. 1 is a perspective view of a loop antenna constructed in accordance with one embodiment of the present invention.

FIG. 1 shows a perspective view of a loop antenna 10 including a ground plane 12, vertical conductors 14,16 and a horizontal conductor 18. Vertical conductors 14,16 are separated from horizontal conductor 18 by gaps 19 and are electrically interconnected by antenna element couplers 20 as shown in FIG. 2.

Figure 2:
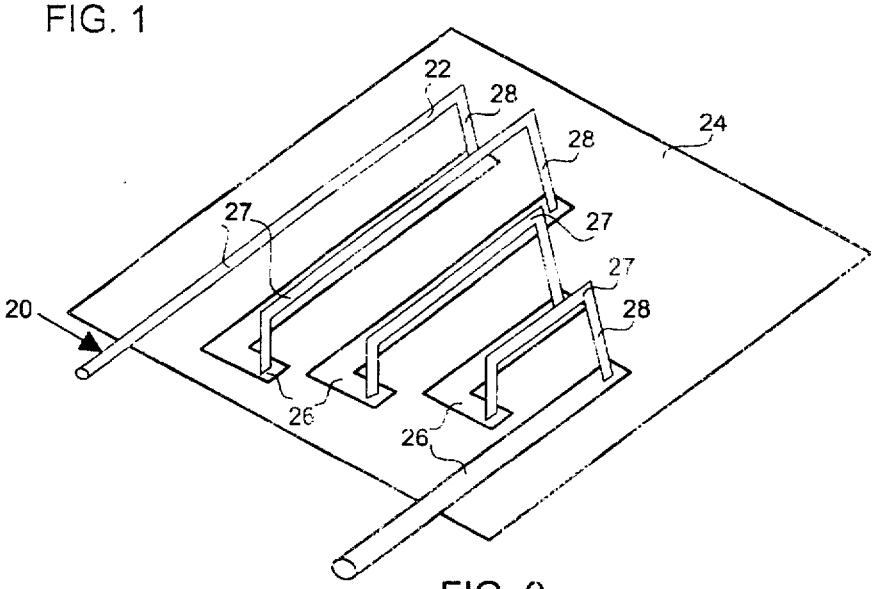
FIG. 2 is a representational perspective view of a meander line used as an antenna element coupler in the antenna of FIG. 1.

FIG. 2 shows a perspective view of a coupler 20 constructed for use on the antenna of FIG. 1. Coupler 20 is a slow wave, meander line in the form of a folded transmission line 22 mounted on a plate 24. With respect to the loop antenna 10 of FIG. 1, either the vertical conductors 14,16 or the horizontal conductor 18 is used as the plate 24. Transmission line 22 is constructed from a folded microstrip line including alternating sections 26,27 thereof, which are mounted close to and separated from the plate 24, respectively. This variation in height from plate 24 of alternating sections 26,27 gives those sections alternating impedance levels with respect to plate 24.

Sections 26, which are located close to plate 24 to form a lower characteristic impedance, are shown as dotted lines which are not intended to represent phantom lines. Sections 26 are electrically insulated from plate 24 by any suitable means such as an insulating material positioned therebetween. Sections 27 are located a controlled distance from plate 24, which distance determines the characteristic impedance of the meander line section 27 in conjunction with the other physical characteristics of the line as well as the frequency of the signal being transmitted over the line.

Sections 26 and 27 are interconnected by folded sections 28 of the microstrip line which are mounted in an orthogonal direction with respect to plate 24. In this form, the transmission line 22 may be constructed as a single continuous folded microstrip line.

Figure 3A:
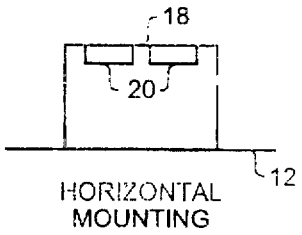
FIGS. 3A and 3B are side views of the loop antenna of FIG. 1 showing mounting alternatives for the element coupler of FIG. 2 on the loop antenna of FIG. 1.
Figure 3B:
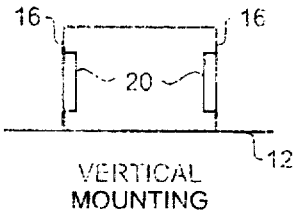

FIGS. 3A and 3B show alternative mounting schemes for the element coupler 20 with respect to the loop antenna 10. FIG. 3A shows the couplers 20 mounted to the horizontal section 18, and FIG. 3B shows the couplers mounted to the vertical sections 14,16. Mounting of the coupler 20 on a radiating element of antenna 10 does not have an appreciable affect on electrical performance.

Figure 4:
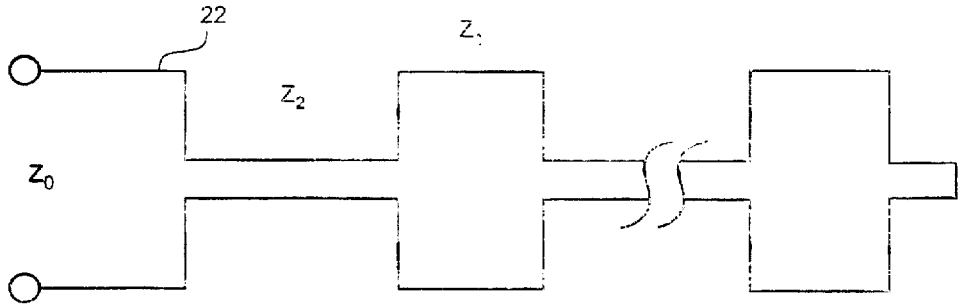
FIG. 4 is a diagram of the electrical image of the element coupler of FIG. 2.

FIG. 4 shows the electrical image of the transmission line 22 having alternating lower and higher impedance sections. The equations below FIG. 4 describe the variation of the propagation constant $\beta$ in relation to the line impedances when the ratio of the higher impedance to the lower impedance is greater than five to one. Generally, the greater the difference is between the lower and higher impedance values, the lower the propagation constant is for the line. These results hold for constant length sections where the lengths are all much less than one-quarter wavelength. The log-periodic version also tends to follow these results.

Figure 5:
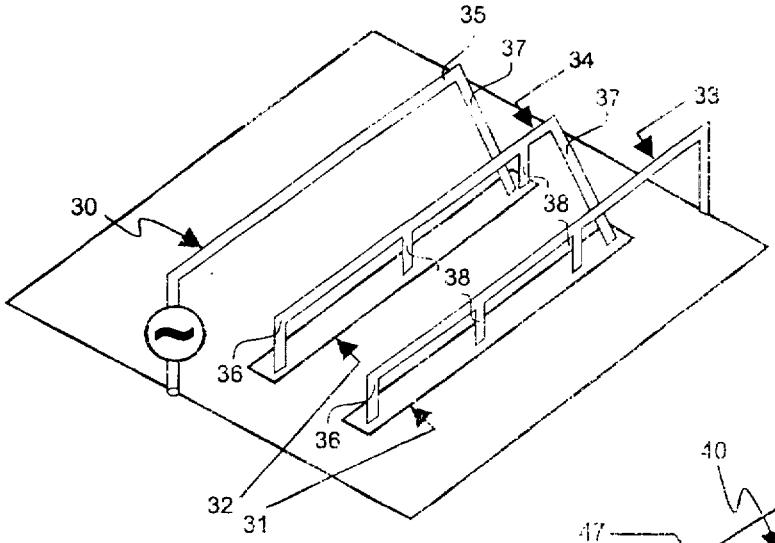
FIG. 5 is a perspective view of a meander line constructed in accordance with another embodiment of the present invention.

FIG. 5 is a representational view of another version of the meander line coupler 30, which includes a plurality of low impedance sections 31, 32 and a plurality of relatively higher impedance sections 33–35. The lower impedance sections 31,32 are located parallel to adjacent higher impedance sections 33,34. Sequential low and higher impedance sections are interconnected by substantially orthogonal sections 36 and by diagonal sections 37. This arrangement enables the construction of shorting switches 38 between the adjacent low and higher impedance sections to provide for electronically switchable control of the length of the meander line 30 and thus the center frequency of the attached antenna. Such switches 38 may take any suitable form such as mechanical switches or electronically controllable switches such as pin diodes. All of the meander line sections 31–35 are of approximately equal length.

Figure 6:
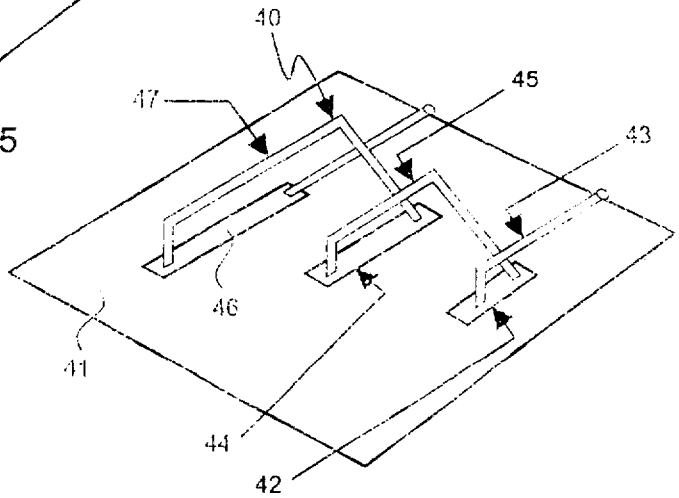
FIG. 6 is a perspective view of a meander line constructed in accordance with another embodiment of the present invention.

FIG. 6 shows a representational, perspective view of another meander line 40 suitable for use with the present invention. Meander line 40 includes lower impedance sections 42,44,46 and higher impedance sections 43,45,47 mounted on a plate 41. Each of the higher impedance sections includes a parallel lower impedance section located parallel thereto for locating shorting switches therebetween. The log-periodic difference in lengths between sequential higher impedance sections allows the logarithmic switching of the meander line length by the shorting of paired lower and higher impedance sections.

A slow wave, meander line for use with the antenna of FIG. 1 may also be constructed in accordance with the descriptions contained in co-pending U.S. Pat. application Ser. No. 08/389,868 entitled SLOW WAVE MEANDER LINE, filed Feb. 17, 1995, by the same inventor.

Figure 7:
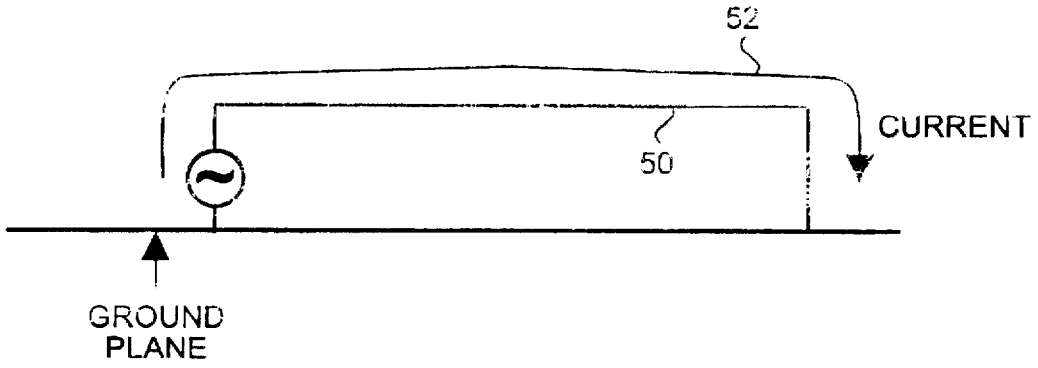
FIG. 7 PRIOR ART
FIG. 7 is a schematic diagram of a loop antenna constructed in accordance with the prior art.

FIG. 7 is a schematic diagram of a loop antenna 50 constructed in accordance with the prior art. Antenna 50 typically circulates current in the direction of the arrow 52. The radiation resistance is proportional to $(\text{freq.})^4$.

Figure 8:
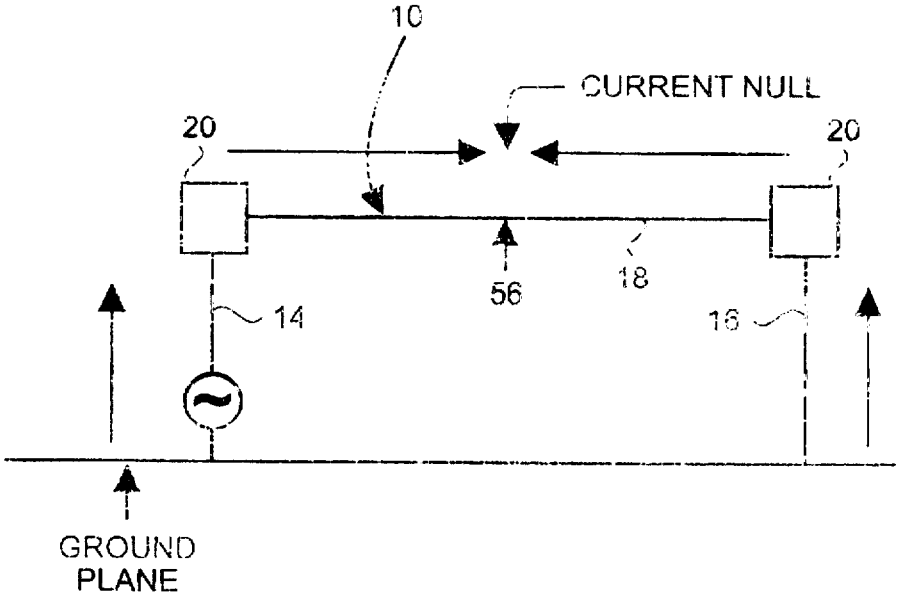
FIG. 8 is a schematic diagram of the loop antenna of FIG. 1.

FIG. 8 is a schematic diagram of the loop antenna 10 of FIG. 1. The vertical and horizontal sections 14,16 and 18 are interconnected by the meander line couplers 20 of FIG. 2. The lengths of the meander line couplers 20 are substantially equal and are selected to provide antenna 10 with an electrical length of one half wavelength at the desired operating frequency. The resulting current null 56 is located at the center of horizontal section 18 and the vertical elements 14,16 are in phase and function as the radiating elements in this half wavelength mode to provide an omnidirectional antenna.

Figure 9:
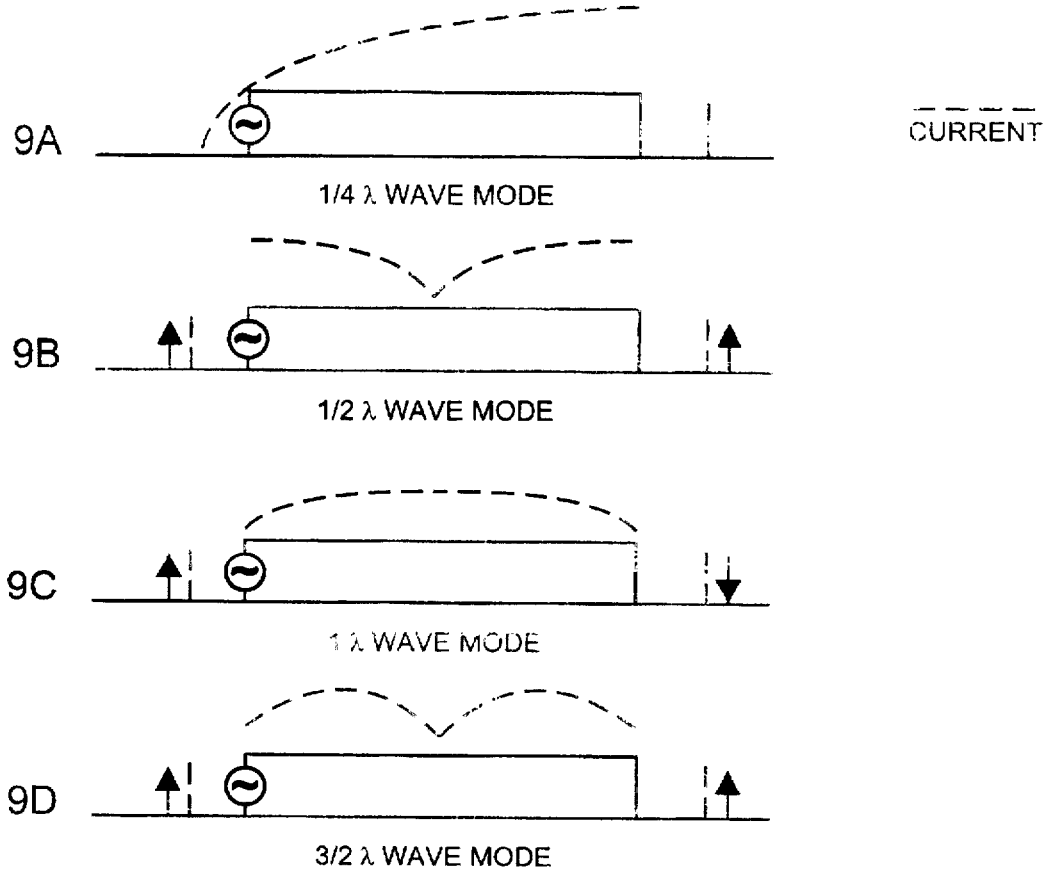
FIG. 9 is a series of comparative diagrams 9A–9D of various operating modes of the antenna of FIG. 1.

FIG. 9 shows comparative different operative modes which can be achieved with the loop antenna 10. Antenna 10 is representationally shown in FIG. 9 without the meander lines 20 for purposes of simplicity. The operating mode of any variation of antenna 10 depends upon the operating frequency and the electrical length of the entire antenna, including the meander lines (not shown). The dotted lines located above the horizontal antenna section 18 in each depiction 9A–9D show the relative current levels along the horizontal sections 18 including the relative peaks and nulls. The arrows located on either side of depictions 9B–9D show the relative current directions therebetween. Thus the meander line of antenna 10 may be designed to provide the antenna with a specific electrical length for a specific operating mode at a specific operating frequency. Likewise, an electronically tunable meander line may be used to provide an antenna with a tunable center frequency and/or tunable modes of operation.

Figure 10:
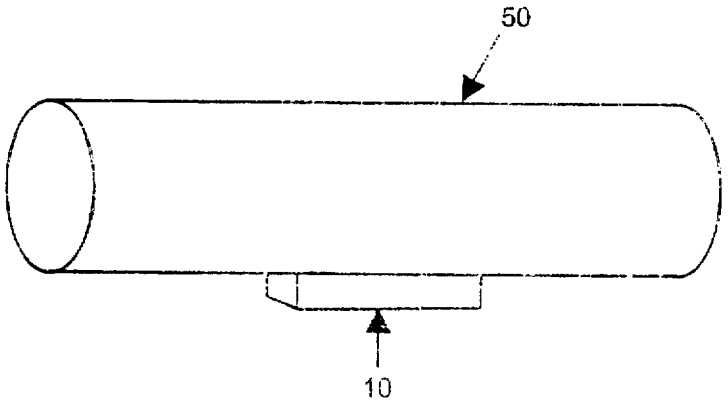
FIG. 10 is a representational view of the antenna of FIG. 1 being used in a particular operating mode to excite a much larger structure as an antenna.

FIG. 10 representationally shows the antenna 10 of FIG. 1 affixed to a cylinder 50 along the upper horizontal surface 18. The meander line lengths and the operating frequency are chosen to excite antenna 10 in a quarter wavelength mode which in turn excites cylinder 50 to radiate as a pair of dipoles. Cylinder 50 represents a large radiating body such as an aircraft fuselage. Such an arrangement can have a sizable affect on gain over that of the antenna 10 by itself. Improvements in coupling between antenna 10 and cylinder 50 may be had for larger cylinder diameters by locating additional antenna structures around the diameter circumference of the cylinder to more effectively engulf the cylinder in magnetic flux.

Conclusion

An antenna of the present invention achieves the efficiency limit of the Chu-Harrington relation while allowing the antenna size to be much less than a wavelength at the frequency of operation. Height reductions of 10 to 1 can be achieved over quarter wavelength monopole antennas with comparable gain. The present invention also provides such an antenna with a practical means of rapid solid state tuning.

The embodiments described above are intended to be taken in an illustrative and not a limiting sense. Various modifications and changes may be made to the above embodiments by persons skilled in the art without departing from the scope of the present invention as defined in the appended claims.

What is claimed is:

1. An antenna, comprising:

a multiplicity of conductive elements adapted for acting as radiating antenna elements including a pair of substantially identical conductive elements and a third conductive element having opposing sides; and a slow wave meander line means adapted to couple electrical signals between the conductive elements and to have an effective electrical length which affects the electrical length and operating characteristics of the antenna, the meander line means including a pair of slow wave meander lines each of which pair is adapted to serially connect a separate one of the paired conductive elements on opposing sides of the third conductive element, wherein the conductive elements are connected to form a loop antenna over a around plane with the pair of conductive elements forming opposite sides of the loop extending from the ground plane and the third conductive element is serially coupled with the slow wave meander lines between the pair of elements and opposite the ground plane.

2. The antenna of claim 1, wherein the slow wave meander lines have switchably tunable lengths.

3. The antenna of claim 2, wherein the pair of substantially identical conductive elements are both vertically and adjacently oriented, and further wherein the meander lines each have a length for causing the pair of conductive elements to react in phase at a predetermined frequency and radiate with an omnidirectional pattern under electrical excitation at the predetermined frequency.

4. The antenna of claim 2, further comprising an elongated body having a larger size than the third conductive element and means for coupling the third conductive element to the elongated body, wherein the meander lines have a predetermined electrical length at predetermined frequency to create a wavelength mode within the antenna which excites the elongated body to effectively radiate under excitation of the antenna at the predetermined frequency.

* * * * *